United States Patent [19]

Ward

[11] Patent Number: 4,900,197

[45] Date of Patent: Feb. 13, 1990

[54] PROCESS FOR HOLDING UP THE LATERAL WALLS OF DEEP DITCHES

[75] Inventor: Jacob Ward, Courbevoie, France

[73] Assignee: Soletanche, Nanterre, France

[21] Appl. No.: 229,224

[22] Filed: Aug. 5, 1988

[30] Foreign Application Priority Data

Aug. 7, 1987 [FR] France ..... 87 11308

[51] Int. Cl.[4] ..... E02D 29/04

[52] U.S. Cl. ..... 405/273; 405/282; 405/272; 405/283

[58] Field of Search ..... 405/273, 283, 287, 284, 405/133, 282, 148, 272

[56] References Cited

U.S. PATENT DOCUMENTS 3,212,270 10/1965 Benintend ..... 405/272
4,685,837 8/1987 Cicanese ..... 405/272 X

FOREIGN PATENT DOCUMENTS 0286762 4/1967 Australia ..... 405/282
1807987 11/1968 Fed. Rep. of Germany ..... 405/133
2325758 12/1974 Fed. Rep. of Germany ..... 405/272
2133055 11/1972 France .
0193626 11/1982 Japan ..... 405/282
0142979 10/1960 U.S.S.R. ..... 405/133
1405879 9/1975 United Kingdom .

OTHER PUBLICATIONS

Patent Abstracts of Japan, vol. 10, No. 295 (M-523) 2351, Oct. 7, 1986 and JP-A-61 109827 (Takenaka Komunten Co. Ltd.) 28-05-1986.

*Primary Examiner*—Dennis L. Taylor
*Assistant Examiner*—J. Russell McBee
*Attorney, Agent, or Firm*—Schweitzer & Cornman

[57] ABSTRACT

The invention relates to a process for propping or supporting the vertical support walls of deep ditches.

After having freely constructed the ditch, to a depth compatible with the resistance of the support walls (1), a ring-shaped plate (3) is provided at the bottom of the ditch, which bears at its periphery against the vertical support walls (1), and which rests on the bottom of the ditch; after the setting of this ring-shaped plate (3), it is attached to the upper part of the support walls (1) for being supported, by means of braces (5); and then, the ditchs is continued, through the orifice (4) of the ring-shaped plate (3), down to the bottom of the work.

3 Claims, 1 Drawing Sheet

PROCESS FOR HOLDING UP THE LATERAL WALLS OF DEEP DITCHES

BACKGROUND OF THE INVENTION

The object of the present invention is a new process for laterally propping or holding up the vertical walls of deep ditches, so as to permit excavation without causing the destruction of these walls.

In construction earthworks, which can be of substantial depth, it is known to provide vertical support walls for these works, by sinking trenches, with a bentonite drilling mud which holds up the walls of these trenches, and then replacing the mud with grout or concrete which, when it hardens, provides the vertical walls of the work, before proceeding the excavation of its interior volume.

According to the technique presently employed, the lateral propping up or support of the vertical walls while the ditch is being dug is provided by constructing one or more floors between different levels of the ditch, which thus can support the horizontal forces exerted by the terrain on the exterior of the vertical walls.

This mode of operation implies that the necessary underpinnings, for supporting the intermediate floors have previously been constructed.

These underpinnings are obtained by drilling shafts which go to the bottom of the building, and introducing posts previously provided with bases into these shafts, which permit the intermediate floors to be supported.

SUMMARY OF THE PRESENT INVENTION

The process according to the invention permits the ditch to be constructed in a simpler, more rapid, and more economical manner.

The object of the present invention is a process for propping or supporting the vertical support walls of deep ditches, characterized by the fact that after having freely dug the ditch, to a depth compatible with the resistance of the support walls, a ring-shaped plate is provided at the bottom of the ditch, which bears at its periphery against the vertical support walls, and which rests on the bottom of the ditch; that after the setting of this ring-shaped plate, it is attached by means of braces, for being supported at the upper part of the support walls; and that then the digging of the ditch is continued, down to the bottom of the work, through the interior of the ring-shaped plate.

According to the invention, it is advantageous for the ring-shaped plate, which takes up the horizontal forces exerted by the terrain on the support walls, to be utilized to constitute part of an intermediate floor.

This can easily be achieved by positioning the ring-shaped plate at a suitable height, and by giving it a shape corresponding to that of the particular floor.

Then it is only necessary, after the ditch is dug, for the ring-shaped plate to be supported by the underpinnings which were provided for supporting the floor, and to close the open central part of the ring-shaped plate, after which it is only necessary to dismount the braces which held up the ring-shaped plate while the ditch was being dug, to obtain the final floor.

In the case of ditches of great depth, which require the horizontal forces exerted by the terrain on the support walls to be taken up at several levels, it is possible according to the invention to successively provide several ring-shaped plates, each of which can advantageously serve as an intermediate floor.

In order to better explain the invention, an illustrative and non-limiting example of an embodiment thereof will be described, which is shown on the attached drawing.

DESCRIPTION OF THE DRAWINGS

In this drawing.

DETAILED DESCRIPTION OF INVENTION

Figure 1:
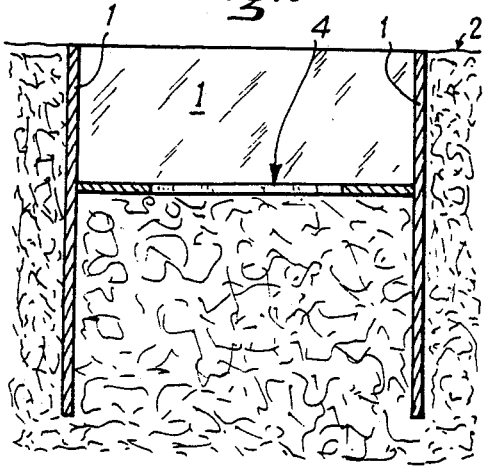
FIG. 1 is a schematic vertical cross-sectional view of an earthwork, in which the ring-shaped plate according to the invention has just been provided.

FIG. 1 is a cross-sectional view of an earthwork, in which the digging of a ditch according to the invention is in progress.

According to a conventional technique, support walls 1 have been constructed at the periphery of the work before beginning the ditch.

When the support walls have been secured, the ditch has been begun, down to a certain depth, as shown in FIG. 1.

Figure 2:
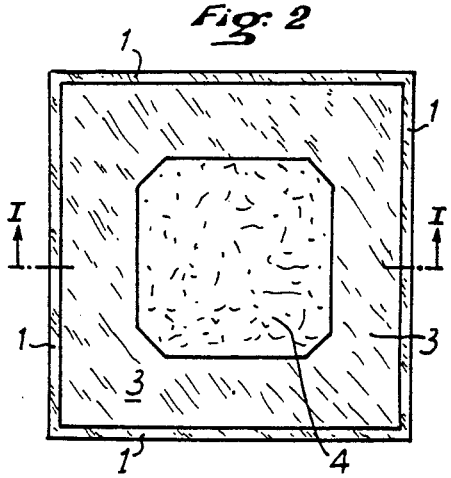
FIG. 2 is a view from above corresponding to FIG. 1.
Figure 3:
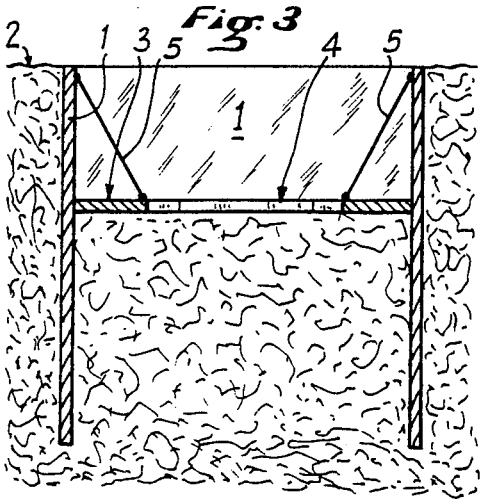
FIG. 3 is a view corresponding to FIG. 1, after the braces have been put in place.
Figure 4:
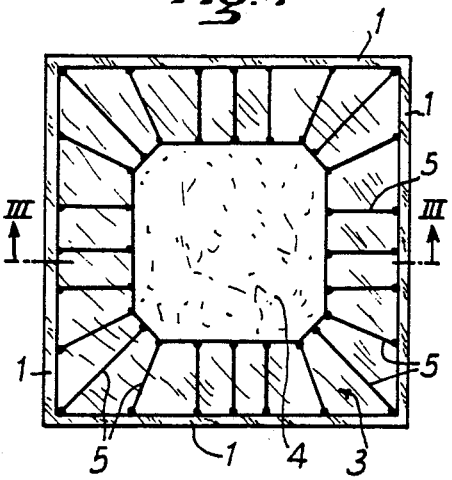
FIG. 4 is a view from above corresponding to FIG. 3.

According to the invention, a ring-shaped plate 3 is then provided, which rests on the bottom of the ditch, and which bears at its periphery against the support walls 1, a substantial opening 4 being left at its center, as can be seen in FIG. 2. When the ring-shaped plate 3 has been put in place, it is attached to the upper part of the support walls, by braces 5, which preferably are articulated at each of their extremities.

In the embodiment shown in the drawings, the lower ends of the braces 5 are fixed to the ring-shaped plate 3 near the opening 4, but it is self-evident that the braces could be fixed at different points on the ring-shaped plate 3.

This operation having been completed, it is only necessary, according to the invention, to then proceed with the ditch in the lower part of the earthwork, to attain its lower level 6.

The execution of this second part of the ditch is highly facilitated by the existence of the opening 4, which has great dimensions, permitting the easy removal of debris.

Figure 5:
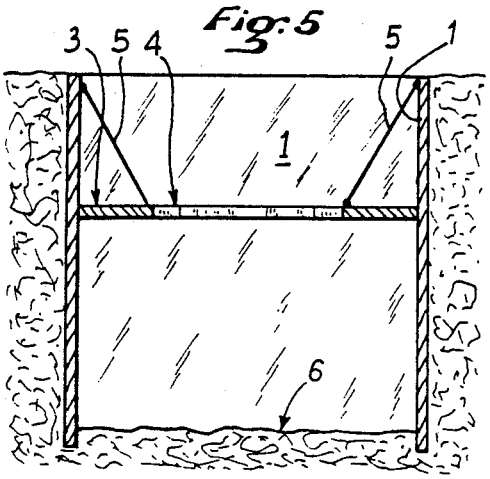
FIG. 5 is a cross-sectional view corresponding to FIG. 3, after completion of the ditch.
Figure 6:
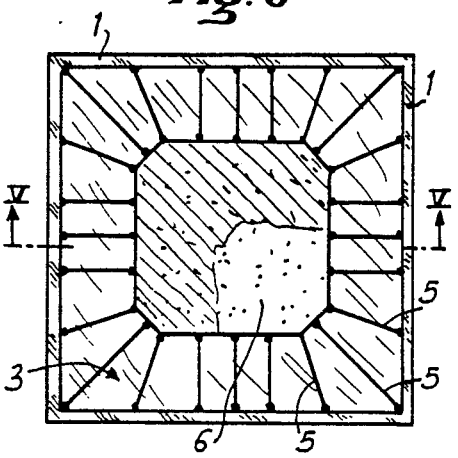
FIG. 6 is a view of FIG. 5, taken from above.

When the ditch is completed, as shown in FIGS. 5 and 6, it is then possible to proceed to the construction of intermediate floors, and to provide underpinning points which support the ring-shaped plate 3, which permits the braces 5 to be dismounted.

The ring-shaped plate 3 thus serves as an element of a floor, it only being necessary to close its central part according to a conventional technique.

It is seen that the process according to the invention allows ditches to be dug in deep earthworks in a simple and economical manner, without it being necessary to construct, at the time the ditch is begun, deep underpinning points to hold up the floor, the floor being provided at the outset to take up the horizontal forces exerted by the terrain on the support walls, so as to allow the ditch to be dug.

It is understood that the embodiment that has been described hereinabove is in no way limiting, and that any desirable modifications can be applied to it, still within the scope of the invention.

First of all, it is self-evident that although the earthwork has been shown as having the shape of a parallelepiped, the invention is applicable to works having any form.

Likewise, it is within the scope of the invention to support the ring-shaped plate, while digging the ditch, by means of braces which are placed differently.

I claim:

1. A method for supporting and reinforcing support walls of deep excavations of predetermined cross-section including the steps of:

(a) securing support walls within the ground;

(b) freely removing earth from the ground within said support walls to establish a ditch of a predetermined first depth compatible with a predetermined resistance of said support walls;

(c) providing a generally ring-shaped plate having a substantial central opening and mounting said plate at the bottom of said ditch in a manner bearing against said support walls;

(d) connecting a series of braces from the top of said walls to said plate;

(e) further removing earth from the ground through said central plate opening to deepen said ditch to a predetermined second depth.

2. The method of claim 1 in which (a) said excavation is of square cross-section.

3. The method of claim 1 further including the steps of:

(a) filling in said opening in said plate to form an intermediate floor;

(b) removing said braces.

* * * * *